United States Patent [19]

Goodman et al.

[11] 4,143,935

[45] Mar. 13, 1979

[54] ELECTRICAL CONNECTOR

[75] Inventors: David S. Goodman, Mission Viejo; James H. Curley, Costa Mesa; Jack E. Langenbach, Newport Beach, all of Calif.

[73] Assignee: International Telephone and Telegraph Corp., New York, N.Y.

[21] Appl. No.: 885,755

[22] Filed: Mar. 13, 1978

[51] Int. Cl.[2] ..... H01R 13/38

[52] U.S. Cl. ..... 339/99 R

[58] Field of Search ..... 339/97 P, 98, 99 R

[56] References Cited

U.S. PATENT DOCUMENTS

| | | | |
|---|---|---|---|
| 4,066,317 | 1/1978 | Bierenfeld et al. | 339/98 |
| 4,083,615 | 4/1978 | Volinskie | 339/99 R |

FOREIGN PATENT DOCUMENTS

| | | | |
|---|---|---|---|
| 2644296 | 4/1978 | Fed. Rep. of Germany | 339/97 P |

*Primary Examiner*—Joseph H. McGlynn

*Attorney, Agent, or Firm*—Thomas L. Peterson

[57] ABSTRACT

An electrical connector for a multi-conductor flat cable wherein the connector housing contains three rows of contacts. The contacts have termination sections which make electrical connections to the conductors of the flat cable by insulation displacing techniques. The termination sections of one row of contacts is higher than those of the other two rows of contacts. The contacts in the other two rows are staggered relative to each other. The flat cable is folded generally longitudinally to provide two layers. A cap is used to force the conductors of one layer of the flat cable into the two lower rows of termination sections, while a second cap is used to force the conductors of the other layer of the flat cable into the higher row of termination sections.

6 Claims, 7 Drawing Figures

ELECTRICAL CONNECTOR

BACKGROUND OF THE INVENTION

The present invention relates generally to an electrical connector for flat cables and, more particularly, to an electrical connector which makes electrical connections to the conductors of the flat cable by insulation displacement techniques.

It is well known in the art to make electrical connections to individual wires or the conductors of flat cables by insulation displacement or solderless connections. The following patents disclose a variety of connectors which operate on this principle: U.S. Pat. No. 3,930,708 (Wedekind et al.), U.S. Pat. No. 3,955,873 (Peterson), U.S. Pat. No. 4,006,957 (Narozny), U.S. Pat. No. 4,073,560 (Anhalt et al.). It is common among the connectors disclosed in the aformentioned patents that the termination sections of the contacts used therein are each provided with a longitudinal slot which forms a pair of jaws into which a conductor, comprising a metallic core covered by insulation, may be pushed, whereby the jaws pierce or display the insulation of the conductor and penetrate the core of the conductor to make electrical and mechanical connection thereto. Typically, the slotted termination section of the contact forms a pair of prongs which are pointed at their ends which facilitates the insertion of the contact into the insulation webbing which joins the parallel conductors of a multi-conductor flat cable. It is also a standard technique used in insulation displacement connectors for connecting to flat cables that the connector contain two rows of contacts with the contacts in each row staggered relative to each other so that when a flat cable is pushed down over the two rows of contacts by a suitable tool or the connector cap, the contacts in the two rows will electrically engage alternate conductors of the flat cable along two parallel paths.

The need has arisen for terminating an electrical connector to a flat cable in which the connector contains three rows of contacts, rather than only two rows as in the prior art connectors discussed above. Because of the required standard spacing of the contacts in the three rows, it is impossible to connect a flat cable to the termination sections of the contacts in single layer in the conventional manner. It is therefore an object of the present invention to provide a novel electrical connector which allows the connection of a multi-conductor flat cable to three rows of contacts. It is another object of this invention to provide a novel flat cable arrangement which faciliates the termination of the aforementioned three row contact connector to the conductors of the cable.

SUMMARY OF THE INVENTION

According to a principal aspect of the present invention, there is provided an electrical connector for two layers of conductors, which conductors may be either individual wires or the conductors of a flat cable. In each instance, the conductor has a metallic core covered by insulation. The connector comprises an elongated housing having a conductor receiving side and a mating side. Three, generally parallel, spaced rows of contact receiving cavities are provided in the housing extending from the conductor receiving side to the mating side. Contacts are mounted in the cavities. Each contact has a contacting section on the mating side of the connector housing and a termination section on the conductor receiving side thereof. The termination sections of the contacts in one row are located at a different level from the termination sections of the contacts in the other two rows. The termination sections of the contacts in the other two rows are staggered relative to each other as in the conventional connectors discussed above. The termination section of each contact embodies insulation piercing, core penetrating jaws. A first insulative cap is removably mounted on the conductor receiving side of the housing, and embodies means for forcibly inserting portions of the conductors of one of the layers of conductors into the jaws of the contacts in said one row. A second insulative cap is also removably mounted on the conductor receiving side of the housing, and embodies means for forcibly inserting portions of the conductors of the other layer of conductors into the jaws of the contacts in the other two rows. In the case of a flat cable terminated to the novel connector of the present invention, the cable is folded generally longitudinally at its end to provide the two layers which are connected to the contacts in the connector. Thus, by the present invention, a flat cable may be connected to an electrical connector having three rows of contacts. Further, by the folding of the flat cable, the invention permits the connection of the conductors of a relatively wide flat cable to a shorter connector than has been otherwise possible in the past. Other aspects and advantages of the invention will become more apparent from the following description taken in connection with the accompanying drawings.

DESCRIPTION OF THE PREFERRED EMBODIMENT

Figure 1:
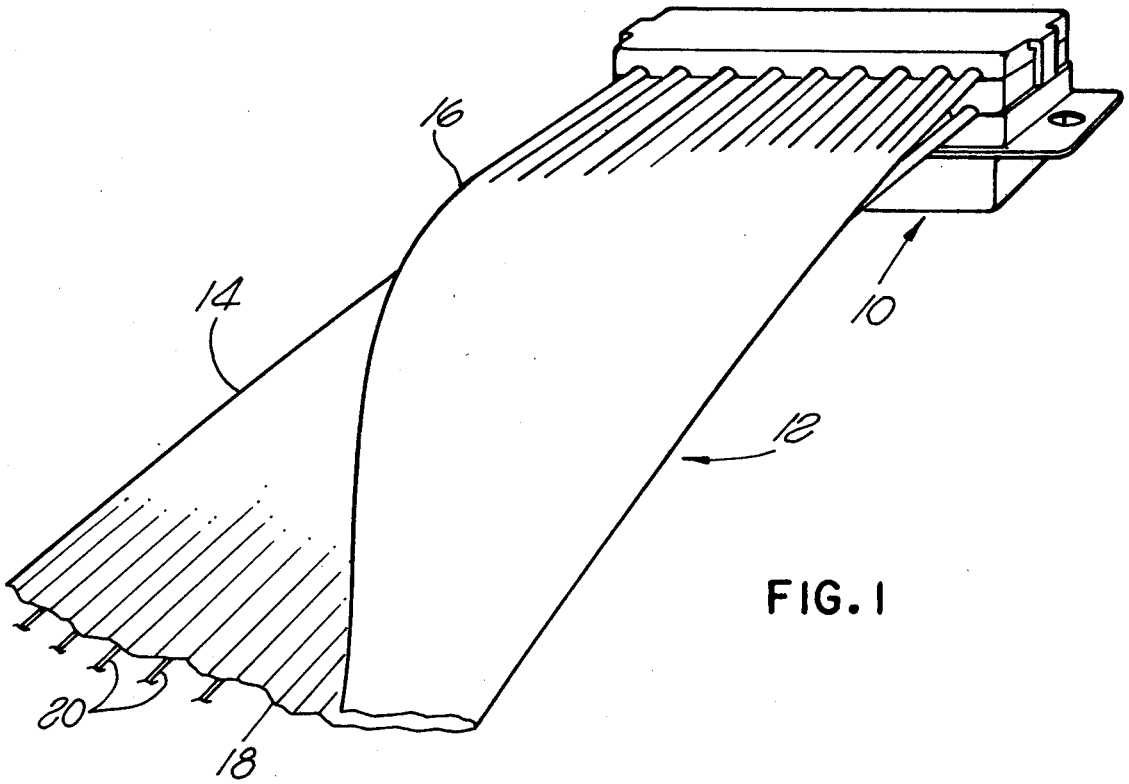
FIG. 1 is a perspective view of the connector of the present invention having a folded, multi-conductor flat cable terminated thereto.

Referring now to FIG. 1 of the drawings in detail, there is illustrated the connector of the present invention, generally designated 10, which is connected to a multi-conductor flat cable 12 which has its end split and folded over into two layers, namely, a lower layer 14 and an upper layer 16. The cable 12 comprises a generally flat, flexible insulation sheet 18 having a plurality of parallel, spaced conductors 20 embedded therein and extending the length of the sheet in the conventional manner. Further details of the terminating end of the cable will be described later herein.

The connector 10 comprises a shell 22 containing an elongated insulative housing 24 in the upper part 26 of the shell. The lower part 28 of the shell provides a recess 30 for receiving a mating connector member, not shown. The upper or rear portion 32 of the housing projects upwardly through an opening 34 in the upper section 26 of the connector shell. A projection 36 extends upwardly from the upper portion 32 of the housing along one edge thereof providing a pair of parallel stepped surfaces 38 and 40, respectively, on the upper portion of the connector housing.

The housing 24 contains three rows of spaced contact cavities 42, 44, and 46. The cavities 42 and 44 extend vertically from the mating or lower side 48 of the housing to the upper surface 38 thereof while the cavities 46 extend vertically from the lower side to the upper surface 40. The surfaces 38 and 40 are on the conductor receiving side of the connector housing.

Figure 3:
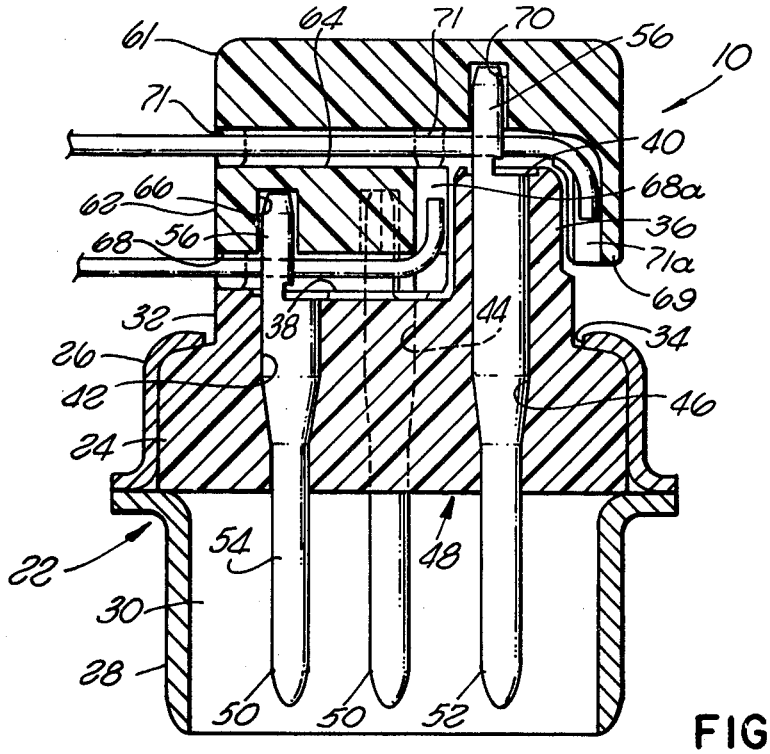
FIG. 3 is a transverse vertical sectional view taken along line 3—3 of FIG. 2.

Contacts 50 are mounted in each of the cavities 42 and 44. Contacts 52 are mounted in the cavities 46. The contacts are all identical except that the contacts 52 are longer than the contacts 50 as best seen in FIG. 3.

Figure 2:
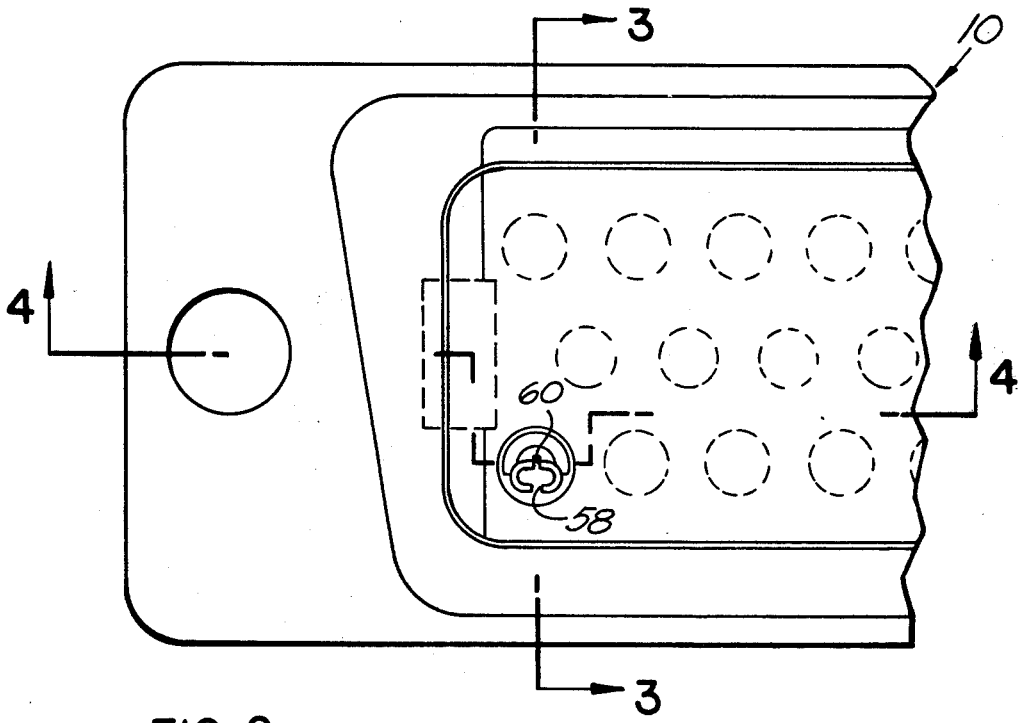
FIG. 2 is a fragmentary top plan view showing one end of the connector illustrated in FIG. 1.

Each contact 50 embodies a lower contacting section 54 and an upper or rear termination section 56. The contacting section 54 is shown as being in the form of a pin contact, which would be engageable with a socket contact on a mating connector member, not shown. The pin contacts extend into the recess 30 formed by the connector shell. The termination section 56 of the contact preferably has a generally tubular configuration. Longitudinal slots 58 and 60 are formed in opposed sides of the tubular termination section of the contact, as best seen in FIG. 2. The slot 60 extends longitudinally through the entire tubular section while the slot 58 opens at only the top of the tubular section. The edges of the slot 60 provides insulation piercing, core pentrating jaws for an insulated conductor while the edges of the slot 58 are spaced apart farther than the edges of the slot 60, and provide insulation penetrating jaws which provide strain relief for a conductor inserted downwardly into the slot. Further details of the termination section 56 of the contacts 50 may be found in the aforementioned Peterson and Anhalt patents, the disclosures of which are incorporated herein by reference.

The contact cavities in the two rows of contacts 42 and 44 are longitudinally staggered relative to each other so that the termination sections of the contacts mounted in the the cavities are likewise staggered. The termination sections of the contacts 50 extend above the surface 38 of the connector housing while the termination sections 56 of the contacts 52 extend above the surface 40 thereof. The slots in the contacts extend in planes which are transverse to the longitudinal axis of the connector housing. The termination sections 56 of the contacts 52 are shown as being aligned with the termination sections 56 of the contacts 50 in the cavities 42. However, it is not necessary that the contacts 52 be aligned with the contacts in either of the rows of cavities 42 and 44.

While the termination sections 56 of the contacts 50 and 52 described hereinabove and illustrated in the drawings is the preferred form for use in the present invention, the invention is not limited to this specific construction. The termination section of each contact may employ different forms of insulation piercing, core penetrating jaws than that described herein. For example, the termination section of each contact could be a flat metal plate with a V-groove or notch formed therein terminating in a slot extending vertically downwardly from the apex of the notch. Such an arrangement would provide electrical connection to the core of the conductor but no strain relief as does the termination section 56.

Figure 4:
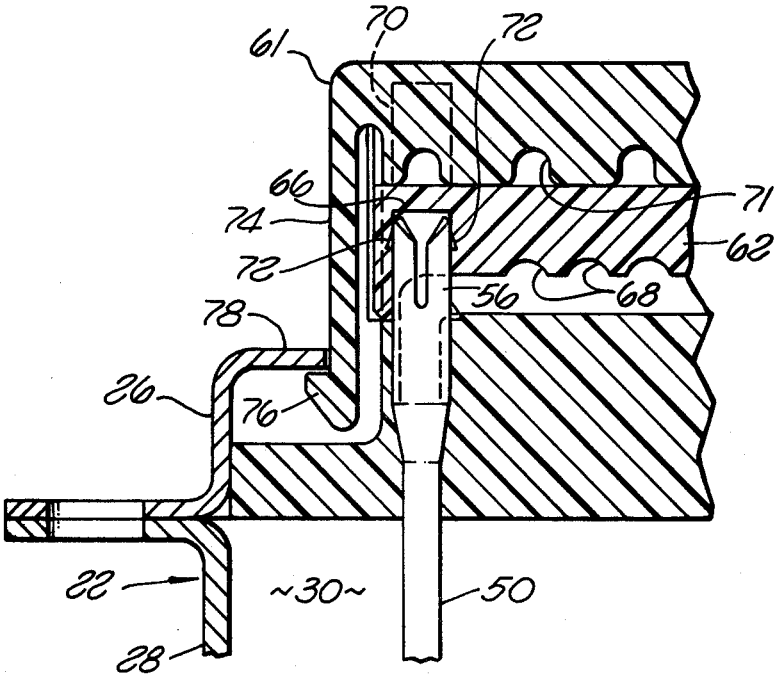
FIG. 4 is a longitudinal vertical sectional view taken along line 4—4 of FIG. 2.

An upper insulative cap 61 and a lower insulative cap 62 are mounted on the conductor receiving side of the connector housing. The cap 62 is mounted over the surface 38 adjacent to the projection 36 on the upper portion of the housing. The upper surface 64 of the lower cap is substantially coplanar with the upper surface 40 of the projection 36. The cap embodies two rows of recesses 66 which receive the termination sections 56 of the contacts 50. Transversely extending grooves 68 are formed on the lower surface of the lower cap 62 along the sides thereof, as best seen in FIGS. 3 and 4. The grooves are spaced apart a distance corresponding to the spacing of the contacts 50 and of the conductors 20 in the lower layer 14 of the flat cable 12. The grooves serve to properly locate the conductors so that when the lower layer 14 of the flat cable is positioned between the cap and surface 38 and the cap is pushed toward the surface 38, the conductors will be forced into the slots 58 and 60 in the termination sections of the contacts 50, whereby electrical and mechanical connection will be provided between the contacts and the conductors.

Figure 6:
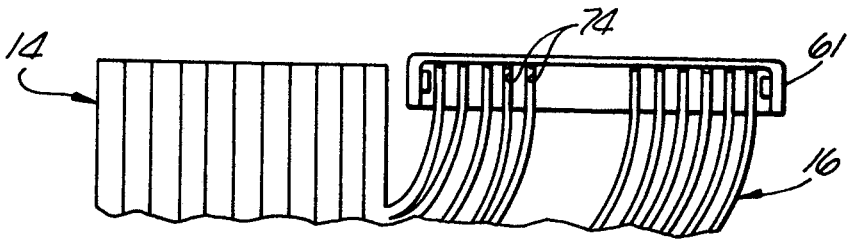
FIG. 6 illustrates how one section of the conductors of the flat cable are mounted to the upper cap of the connector of the present invention.

The upper cap 61 is formed with a skirt 69 which extends downwardly from three sides of the cap, as best seen in FIG. 6. The cap 61 is formed with a row of recesses 70 which receive the termination sections 56 of the contacts 52. A plurality of notches 71 are formed in the lower surface of the cap 61 aligned with the termination sections 56 of contacts 52, as best seen in FIG. 4. The notches 71 serve to locate the conductors of the upper layer 16 of the flat cable 12 so that when the upper layer of the cable is positioned between the upper cap 61 and the surface 40 and the cap is pushed toward said surface, the conductors of the upper layer of the flat cable will be terminated to the termination sections 56 of the contacts 52.

As best seen in FIG. 4, barbs 72 are formed on the opposite sides of the termination section of each contact. These barbs serve to frictionally retain the caps on the contacts. In addition, a downwardly extending resilient leg 74 is formed on each end of the cap 61. A latch element 76 is provided on the lower end of each leg 74. The latch element latches behind a flange 78 on the connector shell 26 when the two caps 61 and 62 are assembled onto the conductor receiving side of the connector housing as best seen in FIG. 4.

Figure 5:
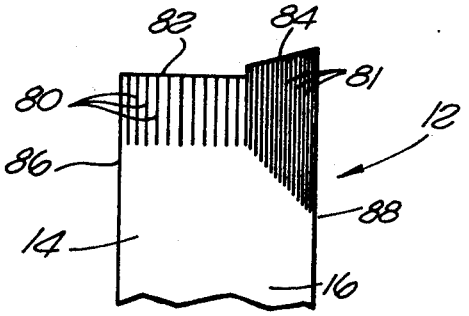
FIG. 5 is a top plan view of the end of the flat cable illustrated in FIG. 1 in an unfolded, planar condition.

Reference is now made to FIG. 5 of the drawings, which illustrates the preferred form of the termination end of the flat cable 12 to be used with the connector 10 of the present invention. As explained in U.S. Pat. No. 4,046,045 to Stevens, assigned to the assignee of the present application, it is desirable to longitudinally slit the insulation between the conductors of a flat cable in order to accommodate for differences between the spacing of the conductors and the center distances between the contacts of the connector to which the flat cable is being connected. By way of example only, it is presumed that the flat cable 12 contains 50 conductors 20. The 17 conductors on the right side of the cable end illustrated in FIG. 5 provide the upper layer 16 of the folded cable illustrated in FIG. 1, while the conductors on the left side of the cable provide the lower layer 14 of the cable. While it is not necessary that the left side of the cable be slit in order to practice the invention, preferably such side is divided into 11 groups of three conductors each by slits indicated by reference numeral 80.

Slits 81 formed in right side of the cable between each of the remaining 17 conductors provide individual insulated wires. The forward end of the cable terminates in first and second edge sections 82 and 84, respectively. The first edge section 82 is normal to the parallel sides 86 and 88 of the insulation sheet of the cable. The first edge section 82 extends extends from the side 86 to the second edge section 84. Thus, all the slits 80 terminate at the normal edge 82. The edge 84 is stepped forwardly of the edge 82 and extends forwardly and at an angle toward the side 88 of the cable. The slits 81 terminate at the second edge section 84. The slits 81 are longer than the slits 80 and the outside slits 81 adjacent to the side 88 of the flat cable are longer than the inside slits 81 adjacent to the slits 80.

In order to assemble the flat cable to the connector 10 of the present invention, initially the upper cap 61 is inverted. The individual conductors of the cable formed by the slits 81 are spread apart and pulled to the right side as viewed in FIG. 6, with the ends of the conductors mounted in the notches 74 in the upper cap. Thereafter, the lower cap 62 is inverted and pushed down onto the lower surface of the upper cap to retain the conductors in the notches 74.

Figure 7:
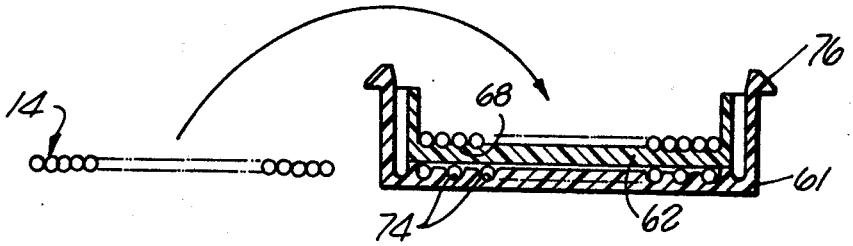
FIG. 7 illustrates how the other section of the flat cable is folded over onto the lower cap of the connector prior to pushing the two caps onto the connector housing.

Thereafter, the flat cable is folded generally longitudinally at its end as indicated by the arrow in FIG. 7 so as to locate the remaining section 14 of the cable on the bottom of the lower cap 62 with the individual conductors of the cable located in the grooves 68. Then the connector housing is inverted and pressed down over the cap assembly whereupon the termination sections of the contacts will become connected to the conductors of the respective upper and lower layers of the flat cable.

It will be appreciated that the special configuration of the forward end of the flat cable 12 of the present invention, with the slits provided therein, allows the two layers of conductors to be disposed parallel to each other with the ends of the conductors terminating in two parallel, spaced vertical planes transverse to the length of the flat cable, as seen in FIG. 3.

Cavity extentions 71*a* of notches 71 in the cap 61 and cavity extensions 68*a* of notches 68 in the cap 62 are provided for the conductors of layers 16 and 14, respectively, (as may be best seen in FIG. 3) so that the positioning of the conductor edges 84 and 82 are not critical and to provide for greater insertion depth of the conductors so that the termination sections 56 of the contacts are not at the ends of conduits.

While the present invention is particularly suited for use with a flat cable, it will be appreciated that the conductor may also be utilized with individual conductors or wires. Further, while in the preferred embodiment disclosed herein the connector contacts three rows of contacts, the invention is also applicable to a connector having two rows of contacts in which the termination sections of the contacts are located at two levels, which permits the use of a connector which is shorter than the width of a flat cable by virtue of the fact that the flat cable may be folded over upon itself at its termination end, with the conductors in the two layers of the cable terminated to the two levels of contacts. The invention also has the advantage that the entire terminating operation may be accomplished after placing the conductors into the connector caps at a single work station with only a single stroke of a press or other similar tool.

What is claimed is:

1. An electrical connector for two layers of conductors, with each conductor having a metallic core covered by insulation, comprising;

an elongated insulative housing;

said housing having a conductor receiving side and a mating side;

three, generally parallel, spaced rows of contact receiving cavities in said housing extending from said conductor receiving side to said mating side;

contacts mounted in said cavities, each said contact having a contacting section on said mating side and a termination section on said conductor receiving side;

the termination sections of the contacts in one row being at a different level from the termination sections of the contacts in the other rows;

the termination sections of the contacts in said other rows being staggered relative to each other;

said termination section of each said contact embodying insulation piercing, core penetrating jaws;

a first insulative cap removably mounted on said conductor receiving side of said housing;

said first cap embodying means for forcibly inserting portions of one of the conductors of one of said layers of conductors into said jaws of said contacts in said one row;

a second insulative cap removably mounted on said conductor receiving side of said housing; and said second cap embodying means for forcibly inserting portions of the conductors of the other layer of conductors into said jaws of said contacts in said other rows.

2. An electrical connector as set forth in claim 1 wherein:

one of said caps overlies the other cap.

3. An electrical connector as set forth in claim 1 in combination with a multi-conductor flat cable wherein:

said flat cable is folded generally longitudinal at one end thereof providing said two layers of conductors;

one of said layers of conductors being clamped between said first cap and said second cap; and the other of said layers of conductors being clamped between said second cap and said housing.

4. An electrical connector as set forth in claim 1 wherein:

the termination sections of the contacts in said one row extend outwardly beyond the termination sections of said contacts in said other rows; and said second cap is disposed between said first cap and said housing.

5. An electrical connector as set forth in claim 4 including:

cooperating latch means on said first cap and said housing for releasably holding said caps on said housing.

6. An electrical connector for two layers of conductors, with each conductor having a metallic core covered by insulation, comprising:

an elongated insulative housing;

said housing having a conductor receiving side and a mating side;

two, generally parallel, spaced rows of contact receiving cavities in said housing extending from said conductor receiving side to said mating side;

individual, separate contacts mounted in said cavities, each said contact having an integral contacting section on said mating side and a termination section on said conductor receiving side;

the terminating sections of the contacts in one row being at a different level from the termination sections of the contacts in the other row;

said termination section of each contact embodying insulation piercing, core penetrating jaws;

a first insulative cap removably mounted on said conductor receiving side of said housing;

said first cap embodying means for forcibly inserting portions of the conductors of one of said layers of conductors into said jaws in said one row;

a second insulative cap removably mounted on said conductor receiving side of said housing;

said second cap embodying means for forcibly inserting portions of the conductors of the other layer of conductors into said jaws of said contacts in said other row; and the jaws of said termination sections of said contacts in both said rows open in the same direction.

* * * * *